United States Patent [19]

Chauvet

[11] Patent Number: 5,018,452

[45] Date of Patent: May 28, 1991

[54] DRIVE SYSTEM FOR TRACK MOUNTED UNDERCARRIAGES AND METHOD FOR USE THEREOF

[76] Inventor: Henri Chauvet, 32 rue de la Fontaine, 92260 Fontenay Aux Roses, France

[21] Appl. No.: 415,206

[22] PCT Filed: Dec. 15, 1988

[86] PCT No.: PCT/FR88/00616

§ 371 Date: Aug. 22, 1989

§ 102(e) Date: Aug. 22, 1989

[87] PCT Pub. No.: WO89/06300

PCT Pub. Date: Jul. 13, 1989

[30] Foreign Application Priority Data

Dec. 30, 1987 [FR] France ..... 87 18414

[51] Int. Cl.[5] ..... A47C 1/00; E04H 3/00

[52] U.S. Cl. ..... 104/172.003; 52/9

[58] Field of Search ..... 104/172.1, 172.2, 172.3; 52/9, 10; 297/232, 234, 239, 241, 248, 249, 257

[56] References Cited

U.S. PATENT DOCUMENTS

| | | | |
|---|---|---|---|
| 308,656 | 12/1884 | Du Bois | 52/9 |
| 2,147,564 | 2/1939 | Vance | 52/10 |
| 3,748,798 | 7/1973 | Mackintosh | 52/10 |
| 4,266,482 | 5/1981 | Barber | 104/172.3 |
| 4,438,702 | 3/1984 | Rhodes | 104/172.3 |
| 4,947,757 | 8/1990 | Theurer | 104/12 |

FOREIGN PATENT DOCUMENTS

| | | | |
|---|---|---|---|
| 0002865 | 11/1979 | European Pat. Off. . | |
| 1015210 | 9/1957 | Fed. Rep. of Germany . | |
| 1254852 | 1/1960 | Fed. Rep. of Germany . | |
| 2035188 | 1/1972 | Fed. Rep. of Germany . | |
| 2735911 | 2/1979 | Fed. Rep. of Germany | 52/9 |
| 369879 | 1/1907 | France . | |
| 1287511 | 2/1962 | France . | |
| 2500509 | 8/1982 | France . | |
| 0601084 | 12/1959 | Italy | 104/172.1 |
| 0775760 | 5/1957 | United Kingdom | 52/9 |

*Primary Examiner*—Robert J. Oberleitner
*Assistant Examiner*—Mark T. Le
*Attorney, Agent, or Firm*—Sughrue, Mion, Zinn, Macpeak & Seas

[57] ABSTRACT

The present invention concerns a system for driving movable undercarriages along a rail, and a procedure for its implementation. This system provides for the movement from a first area, in which the undercarriages are positioned in close proximity, to a second area, in which they are spread apart, and vice versa. The invention is characterized by the fact that it incorporates:

at least two undercarriages (6, 6') connected by a flexible or pliable connection element (26), and stop-blocks (15) for driving the undercarriages by means of a device which is retractable in a storage configuration, the stop-blocks being arranged on a drive chain (13) at predetermined intervals. The invention also concerns an application of the invention to equipment for the storage and arrangement of seats, as well as to its implementation procedure.

17 Claims, 4 Drawing Sheets

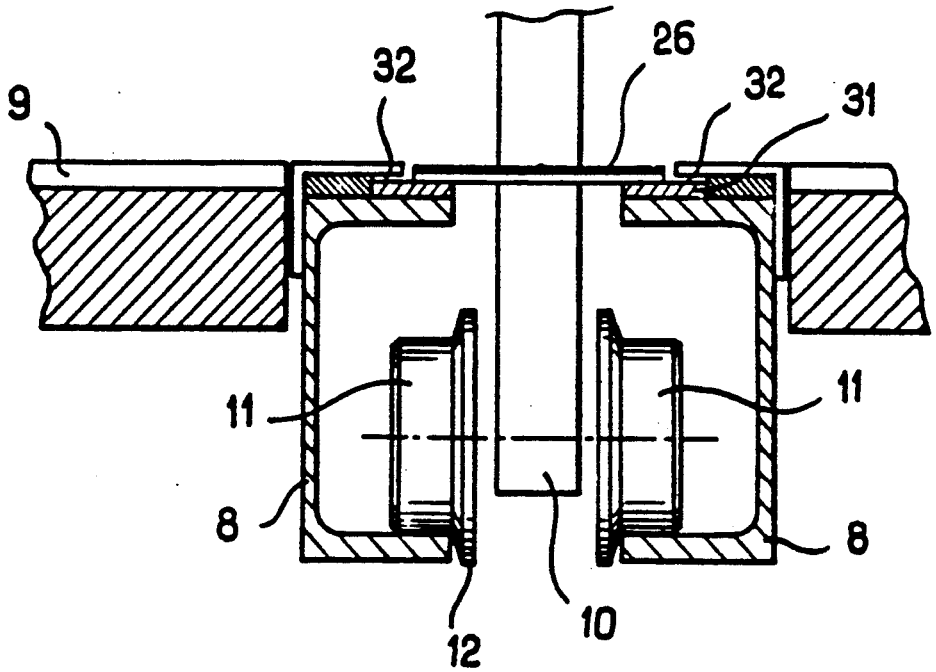
FIG. 6
FIG. 7
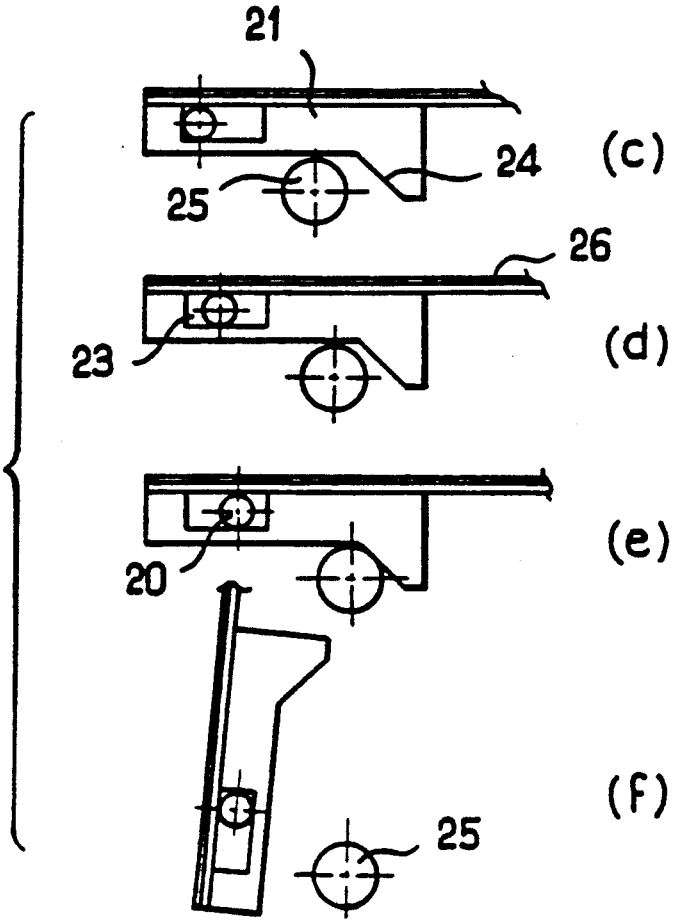

DRIVE SYSTEM FOR TRACK MOUNTED UNDERCARRIAGES AND METHOD FOR USE THEREOF

BACKGROUND OF THE INVENTION

1. Field of the Invention

The present invention concerns a system and procedure for driving movable undercarriages along a rail, as well as its application to equipment and a procedure for storage and the positioning of seats in a multi-event auditorium.

2. Description of the Prior Art

The current state-of-the-art offers auditoriums equipped with movable seats, in order to provide floor-space which may be used, for example, as a dance floor, for banquets, or for exhibition stands. The transformation of the auditorium may be accomplished manually by means of a burdensome and crude procedure consisting in dismantling the seats one by one and storing them in an adjoining room, or vice versa.

A more flexible solution is described in Patent FR1.287.511, according to which at least one retractable floor can be laid over an immobile floor using devices equipped with wheels and jacks which allow them either to roll or to rest in stable fashion on the immovable floor. Storage is accomplished by means of recesses whose dimensions are large enough to store at least one retractable floor. An installation of this kind nevertheless requires rather large storage capacities and, even so, manual positioning and attachment of the various floors.

There is also a well-known solution prescribing the pivoting of the floor either flat or in an inclined position, respectively, by executing a half-turn around a central horizontal shaft as described in Patent No. FR-369.879, or shaft located at the edge of the auditorium, as described in European Patent Application N° 0.002.865. These installations are not very satisfactory, since they require large pits for maneuvering the floors, and do not allow inclination of the floor as may be required by the specific event.

Furthermore, there are auditoriums equipped with seats mounted on rollers which may be moved in guide-grooves in the floor. The number and arrangement of the seats can be changed by moving each seat within the auditorium or outside it. This embodiment, described in German Patent N° 1.1015.210 is marked in particular by the disadvantage of also requiring a large adjoining storage area, should the removal of all seats be desired.

Further, Patent N° DE-1.254.852 describes equipment for the storage and positioning of rows of seats, incorporating at least two undercarriages attached with a connection element. This equipment has disadvantages when deployed, particularly as regards spectator safety.

Finally, Patent N° FR-2.500.509 describes a floor incorporating at least two elements hinged together, on of these elements having retractable rails on which several rows of seats can be slid; however, this patent does not advocate automatic mechanisms for moving them.

SUMMARY OF THE INVENTION

The object of the present invention thus consists in eliminating the disadvantages mentioned above by proposing equipment for the storage and set-up of seats from a smallcapacity storage area to an area of use, by implementing an automatic undercarriage-propulsion system and procedure.

As a second objective, the invention provides for the automatic removal of seats from a floor incorporating several slopes, so that it may be transformed into a floor having a single inclination without seats, and vice versa.

A further objective of the present objective is to allow the partial positioning of rows of seats, depending on the use planned for the auditorium.

For this purpose, the primary object of the invention is a system for the propulsion of movable undercarriages along a rail, thereby providing for movement from a first area in which the undercarriages are positioned in close proximity, to a second area in which the undercarriages are spread apart, and vice versa, said system comprising at least two undercarriages attached with a flexible or pliable connection element.

This system is characterized by the fact that said connection element has a predetermined range of movement (D) in relation to the undercarriage in the direction of the rail, and by the fact that the system incorporates, in addition, stopblocks for driving the undercarriages by means of a device which is retractable when in a storage configuration, said blocks being arranged on a drive-train at predetermined intervals having a length of between L and (L-D), L being the maximum length of the spacing between two consecutive undercarriages and said chain being attached to the last undercarriage and extending parallel to the rail over the entire second area and over part of the first area.

According to a first feature of the system said range of motion is created by the longitudinal play of at least one joint of the connection element found on the undercarriage.

According to a second feature, the retractable device on the undercarriages is elongated, jointed to the undercarriage, and is subjected to the return motion produced by a spring tending to hold it in a protruding position in the direction of the storage area, said device being retractable upwards as the stop-blocks move toward said storage area.

Another invention object, resulting from the application of the system described above, is the automated equipment for the storage and set-up of seats in an auditorium whose floor incorporates at least two longitudinal rails. This equipment is characterized by the combination of the following features:

- rows of seats mounted on beams and resting on at least two undercarriages placed one on each of the two rails; and
- a system for each rail for driving the undercarriages according to the system mentioned above, said connection element being capable of covering the rail.

In accordance with a particularly advantageous embodiment of this equipment, said connection element is composed of two sheets connected by at least one hinge positioned at an approximately central point.

According to another feature of this equipment embodiment, the range of motion the connection element of said system is achieved on the upstream plate, which also comprises an inclined panel set in the direction of the storage area and designed to initiate the folding of the sheets when a stop on the undercarriage obstructs it at the beginning of the storage operation.

According to yet another equipment feature, the floor comprises, at its upper level above the rails, lateral grooves set opposite to one another, in which, when the seats are stored, an element for the continuous covering of the rails can slide.

Finally, according to an especially advantageous feature, said undercarriage-driving system also draws with it the continuous covering element, which is attached to the last undercarriage.

The objects of the present invention also include a procedure for the implementation of the undercarriage storage and positioning system.

When deployed, this process includes a first phase in which the upstream undercarriage, driven by the drive-chain, draws the downstream undercarriage from the storage area (into which the chain does not extend) to the drive train, by means of the stressed connection element; in a second phase, said downstream undercarriage is drawn individually by a conveyor stop-block on the chain.

In a first phase of reverse drive, the upstream undercarriage is driven back toward the downstream undercarriage in order to compress or fold the connection element; finally, the downstream row of seats is driven back by the upstream row of seats because the upstream undercarriage comes into contact with the downstream undercarriage.

The final object of the present invention is the application of this procedure to the automatic equipment for the storage and arrangement of the auditorium seats. The process is identical to that just described, except:

in a first phase of deployment, the covering strip is additionally made to slide simultaneously in the direction opposite to the storage area;

and in a first phase of reverse drive, the continuous covering strip is additionally made to slide toward the storage area.

Other features and advantages of the present invention will emerge in more detail in the following description of an embodiment provided as an example and with reference to the attached drawings, in which:

BRIEF DESCRIPTION OF THE DRAWINGS

FIG. 6 is a view along line A—A of FIG. 4, showing the rail and the undercarriage in transverse section;

FIG. 7 shows four positions of the upstream plate in relation to the undercarriage in different phases of the procedure.

DESCRIPTION OF THE PREFERRED EMBODIMENTS

Figure 1:
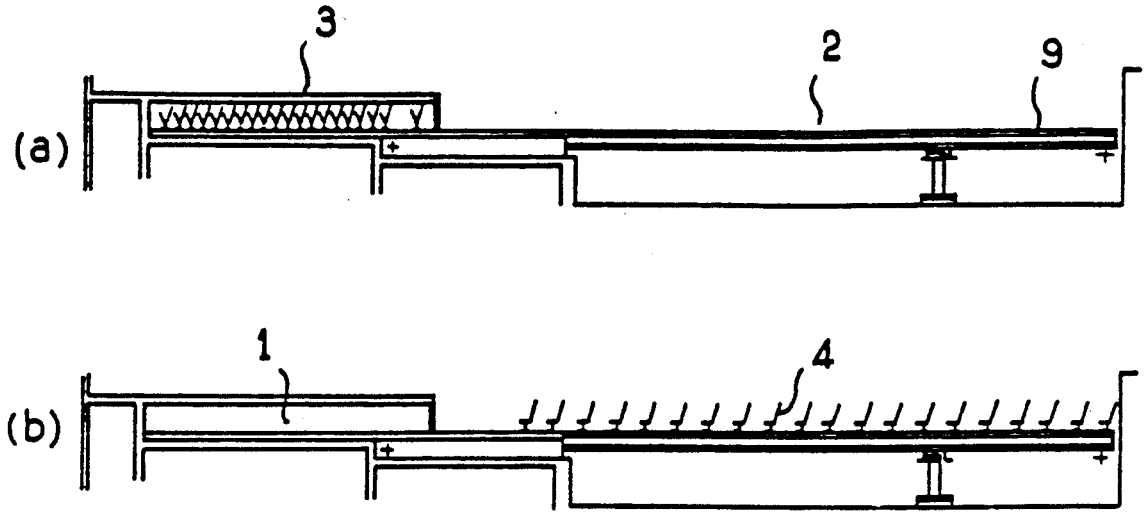
FIG. 1 is an overall view of an auditorium and of seats in storage (1*a*) and arrangement (1*b*) positions.

FIG. 1 illustrates the fact that the installation is divided into two juxtaposed areas with uninterrupted passage between them. A first area (1) is intended for seat storage, and a second (2) for their arrangement in the multi-event auditorium. The storage area lies advantageously in a space beneath the stage (3); it could, however, be located opposite the stage, at the rear of the hall.

The installation (FIGS. 2 and 3) comprises, first, rows of seats (4) mounted on metal beams (5) resting on at least two rolling undercarriages (6, 6'), and second, means for moving the seats from one area to the other, and vice versa.

The means for moving a row of seats mounted on a beam comprise motor-driven mechanisms for driving said rolling undercarriages, which operate individually in conjunction with a rail (7) for the purposes of guiding and "haulage".

Figure 3:
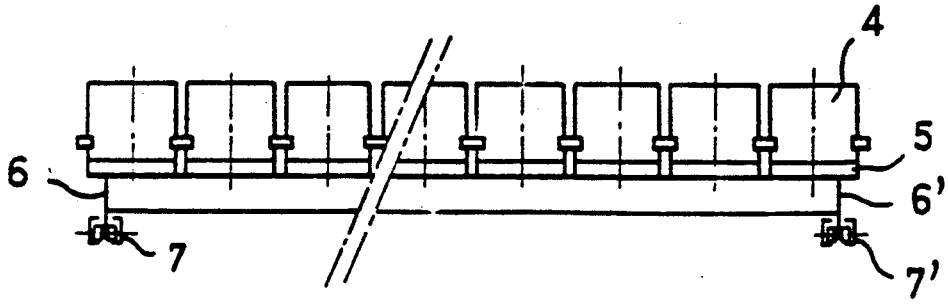
FIG. 3 shows a row of seats mounted on a beam.

FIGS. 3 and 7 show that each rail is composed of two metal beams (8) having a U-shaped cross-section and laid parallel one to the other, their concave parts set opposite to each other so as to form an upper and lower groove. They extend over the entire length of the first and second areas, and their upper surface is slightly on this side of the floor level (9).

The undercarriage is composed of a frame (10) mounted on four wheels (11) fitted with inner circular collars (12) which ensure that the undercarriage will be guided in the lower groove of the rail. The rolling surface is made up of the inner surface of the lower arm of each beam.

Figure 2:
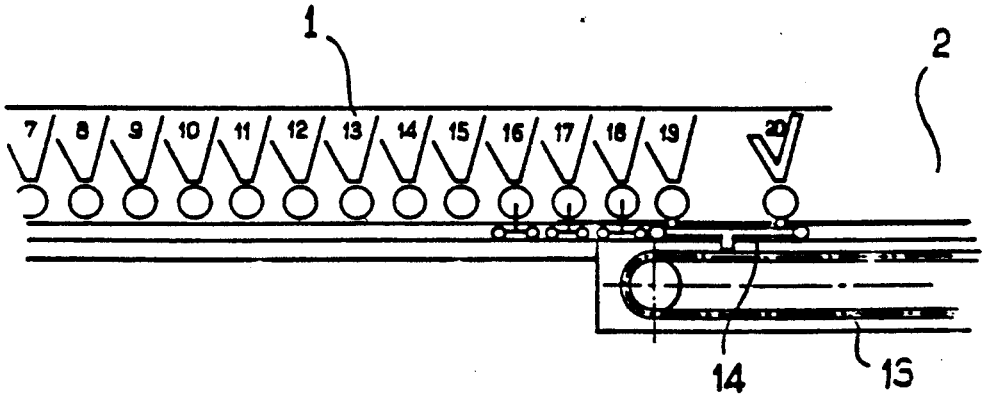
FIG. 2 is a partial view of the equipment showing the connection of the last undercarriage to the chain and demarcating an area in which the drive-chain does not extend.
Figure 4:
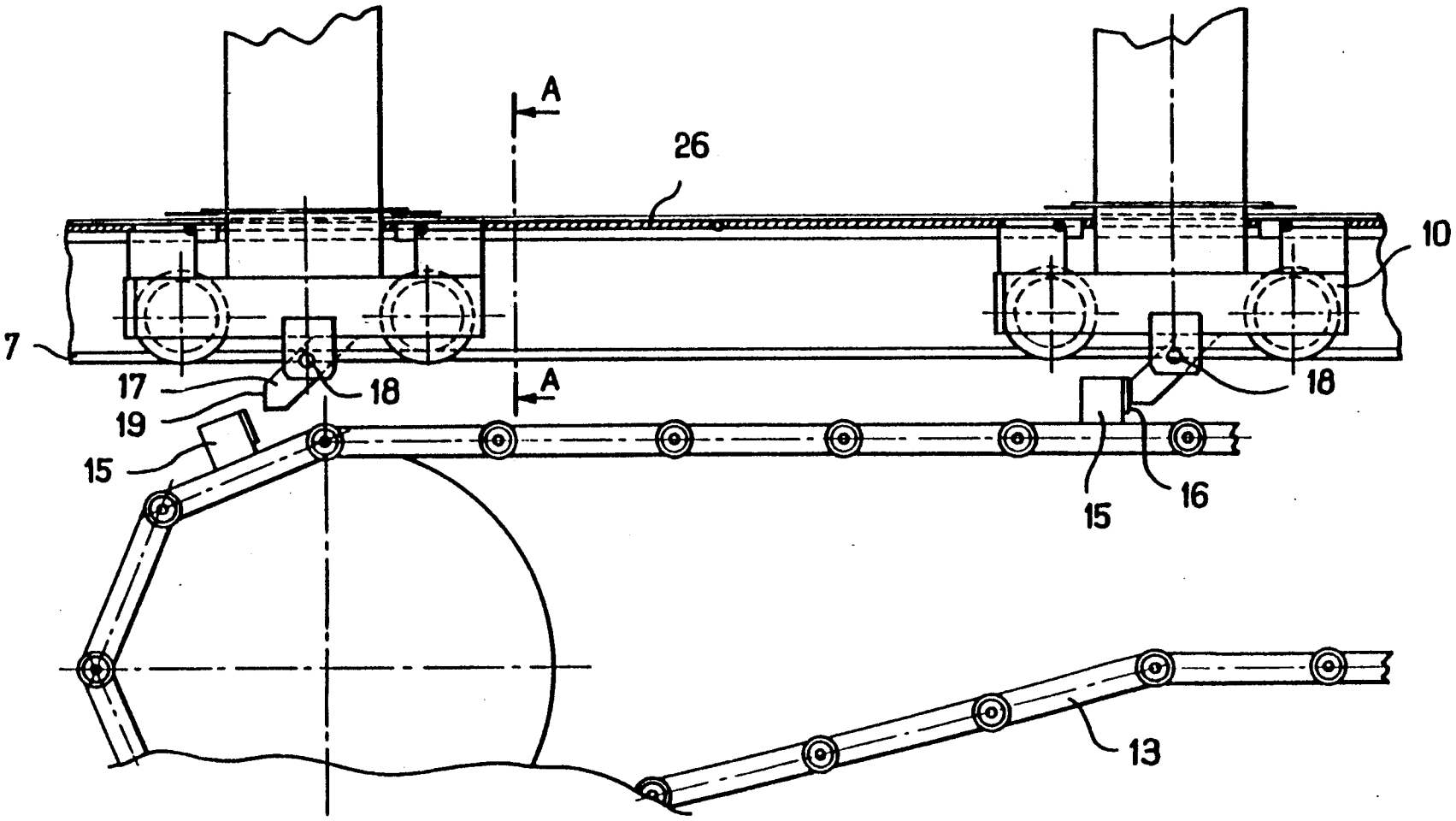
FIG. 4 is a view of two undercarriages from left to right, downstream and upstream, respectively, driven by a chain.

FIGS. 2 and 4 shows that the motor-driven mechanisms for linear drive are composed of two synchronized chains (13) which extend into the first area and over the entire length of the second. They turn around a motorized toothed wheel and a toothed return wheel. The chains are composed of 190 mm links and can support a breaking load of 5.6 tons, calculated to correspond to the movement of 20 rows of 14 seats. It will be noted that only the last undercarriages (14) are attached to the links of their respective drive chains. Without changing the principle underlying the invention, it may be useful to attach the chain approximately in the middle of a long-bed undercarriage supporting the two last rows of seats, in order to allow the positioning of the last row beyond the rear return wheel.

Furthermore, each chain is fitted with conveyor stop-blocks (15) for the movement of individual undercarriages. These stopblocks have a vertical engagement surface (16), and the length separating them is equal to the width of the span between two installed rows of seats. In this specific embodiment, the distance between two consecutive stop-blocks has been set at 850 mm.

As in FIG. 4, the undercarriages incorporate a hooking device (17) projecting downward and having an elongated shape, which is inclined approximately 30, in relation to the vertical toward the storage area. This device, mounted in rotation around a horizontal shaft (18) in the undercarriage, is acted upon by the tension provided by a spring (not shown), which tends to hold it in the projecting position. The lower end (19) is designed to obstruct the engagement surface of the stop-block, while the other end abuts against the base of the undercarriage.

Figure 5:
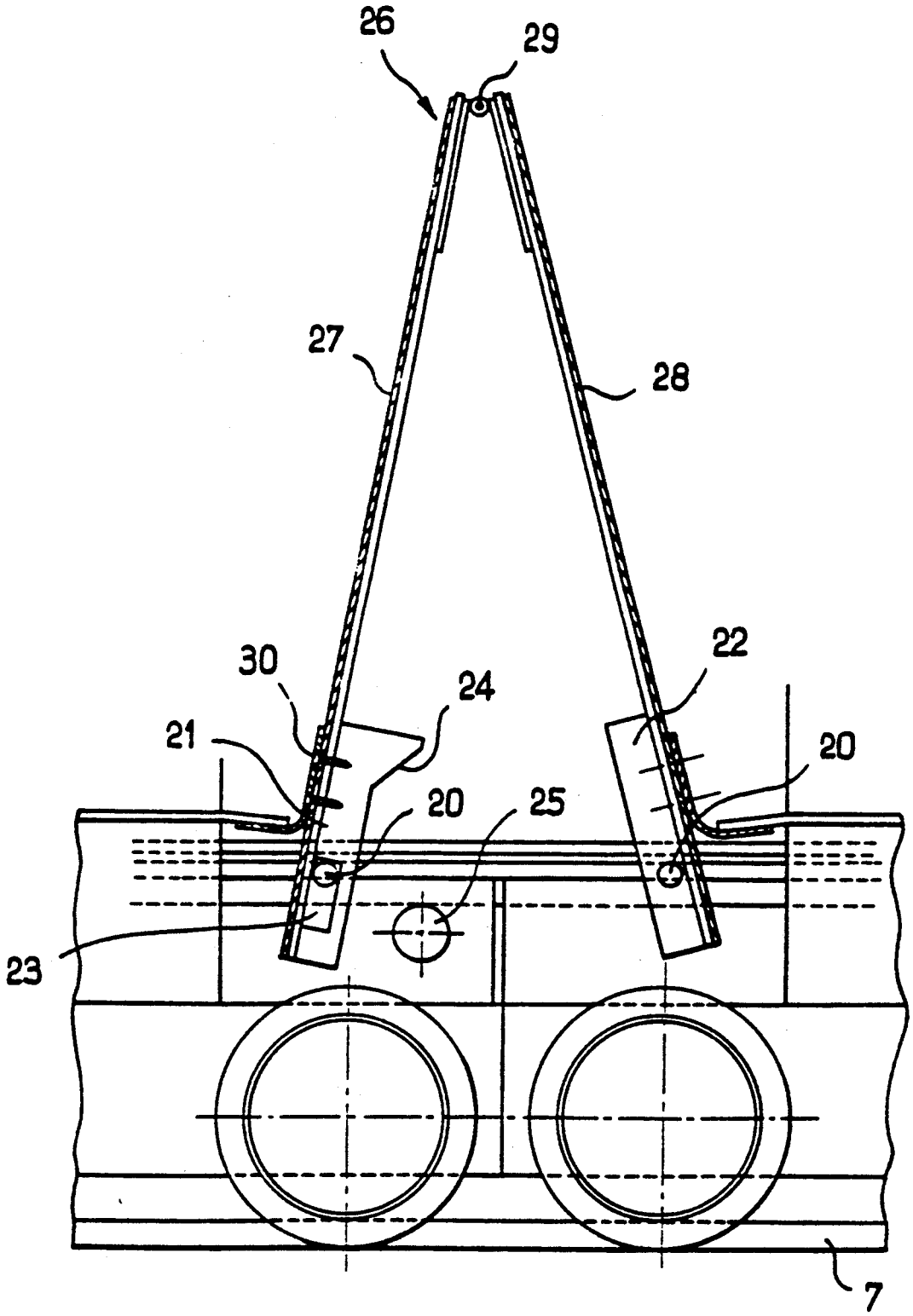
FIG. 5 shows two undercarriages, one drawn close to the other, the connecting sheet being folded.

FIG. 5 shows that the undercarriage also has horizontal hinges made up of a shaft (20) forming one piece with the undercarriage and upstream and downstream jointing plates (21, 22) composed of two pieces, a lower part and a cover plate.

The upstream plate (21) on each undercarriage has a recess (23), rectangular in cross-section and about 20 mm in length, which allows the plate to have a longitudinal range of motion (D) of about 15 mm, taking into account the diameter of the jointing shaft. This plate also has, from left to right, a lower flat surface ending in a panel (24) having a downward slope of approximately 45° and designed to come into contact with a stop (25) on the undercarriage located beneath the flat surface of the plate and which initiates its inclination. In FIG. 5, this stop is cylindrical in shape and is soldered horizontally to the undercarriage. The maximum distance separating the cylinder from the inclined plane must be less than the range of movement of the plate (or about 10 mm).

The undercarriages are connected by a connection element (26) which makes it possible to bring the undercarriages into proximity with one another (possibly with the exception of the two last rows, if they are supported by one long-bed undercarriage). It may be flexible when bent but rigid under traction; or, as in the embodiment shown, it may be formed from two sheets (27, 28) incorporating a joint (29) positioned approximately in the middle and slightly wider than the grooves formed by the guide rails. They are attached to the plates by devices which are dismountable, for example, by screwing (30). The maximum predetermined distance (L) of the spacing between the two undercarriages is 850 mm. In this embodiment, this distance holds true for all spacings, but advantage may be gained by increasing it progressively as a function of the distance from the stage, to improve the spectators' ability to see when the floor is horizontal.

According to the invention, the seats are preferably constructed so as to fold, in order to be able to bring the rows as close together as possible until the undercarriages touch. The sheets are then folded, forming an acute angle, and are positioned nearly vertically between two consecutive rows.

Thus the maximum space occupied by the seats is equal to the cumulative length of the undercarriages in their contiguous configuration, and the storage area can be considerably reduced so as to match the storage capacity located under the stage. For example, the storage space can be reduced to at least half of the space required by the fully-arranged seats.

In an application in which the floors may be sloped, the sheets involved in each inclination of the floor are fitted with several joints enabling them to correspond to the potential change of slope.

The equipment operates in the following manner. FIG. 1*a*shows diagrammatically that the seats are stored under the stage. In this configuration, all of the rows, with the exception of the last, are beyond the chain, i.e., the hooking devices are beyond the range of the conveyor stop-blocks.

When in operation, the chain is activated, and the last (or also the penultimate) row is drawn out of the storage area while moving away from the next row, while the angle created between the two sheets increases as the row is propelled away. When the angle reaches 180°, the following row is drawn outward by means of the connection sheets, and the distance separating the two moving undercarriages is then at its maximum (L), the upstream plate taking on the configuration (c) (FIG. 7) in which, in the horizontal position, it moves away to the maximum extent from the stop (25) on the undercarriage.

The row is moved within range of the stop-blocks on the chain at a speed identical to the linear speed of the chain. The stop-block touches the hooking device on the undercarriage while still on the peripherY of the toothed wheel. Beginning at that point and for as long as the stop-block describes the arc of a circle, a transition phase takes place in which the chain takes over the forward movement of the undercarriage by means of the stop-block, and during which the row of seats being hooked onto a undercarriage is brought closer to the preceding row until the distance separating it from the preceding row equals the distance separating two consecutive stop-blocks, and the plate takes on the configuration (d) in which the jointing shaft and the stop are both capable of free motion upstream and downstream, respectively.

The following rows are deployed following a process identical to the one described above.

When all of the rows have been positioned, the forward drive of the chain is deactivated by an end-of-travel sensor, for example, and a system providing for the immobilization of each undercarriage is triggered. This latter system may, for example, incorporate brakes which, fastened to the rails at points corresponding to the positions of the seats, generate an adjustable intensity of friction on the frame of each undercarriage.

A system of this kind may advantageously be made with a cam turning around a shaft fastened to the rail, which is pivoted by a lever connected to a common rod parallel to the rail and activated by a jack installed at the end of the rail. This cam comes into contact with the upper surface of the undercarriage and obstructs its movement, allowing no slack whatever. Of course, other blocking means could be used.

The storage of the seats takes place using the following procedure. The drive-chain, activated in the direction opposite to that of the preceding operation, drives the last undercarriages toward the storage area. As the undercarriage draws close to the front-most row, the cylinder comes into contact with the sloping panel of the plate (in accordance with configuration (e), FIG. 7), which causes it to swing upward, thereby, of course, initiating the folding of the connection sheets. These latter sheets continue to fold until the front part of the moving undercarriage comes into contact with the rear of the preceding undercarriage (configuration (f), plate raised). This second undercarriage, in turn draws nearer to the preceding one, and functions in the manner already described. Thus, all of the undercarriages are pushed in turn by the last row to the storage area, and another end-of-travel switch halts the process. To absorb the shock caused by contact between undercarriages, a neoprene-type elastic foam, or any other shock-absorber system, may be provided as a covering on contact surfaces.

It must be stressed that the hooking devices are then retractable upward as the conveyor stop-blocks pass by; furthermore, to ensure the correct operation of the equipment, the motor-driven chains should, of course, be synchronized.

The sealing of the grooves once the seats have been stored also occurs by means of a cover strip (not shown), for example, a flexible metal plate which is as long as the rails in the operational area. This plate slides flat in lateral grooves (32) facing one another at floor level. The covering occurs simultaneously with the reverse drive of the rows toward the storage area, because the metal strip is hooked to the rear of the last undercarriage and fills in the gap in the groove as it moves.

In the other direction, this strip may, first, be pulled by a press-roller system (not shown) located beneath the floor at the rear of the hall, and second, pushed by the last undercarriage, a press-roller pressing the plate against a driving roller. In a variant embodiment in which the rollers act only for guiding, the lower surface of the grooves is lined with a material (31) having a low coefficient of friction. The plate may be wound on a wheel beneath the floor, or left in its free, unwound state.

Thus, as the seats are being stored, the cavities in the rail grooves are sealed by the unwinding of the plate; the floor surface thus becomes even.

The advantage of this equipment lies in its ability to deploy a limited number of seats through relatively simple operation. All that is necessary for this operation is to break the connection between two rows before deployment. The break preferably occurs at the downstream plate of a undercarriage, by removing, for example, the screw assembly attaching the sheet to the plate.

The present invention may be applied in an especially successful way to floors incorporating several predetermined slopes and from which seats are to be removed for a show or concert, for example, before standing audiences. In these cases, it is advisable to use a floor having a single, relatively slight (5%) inclination to allow good visibility. In a very advantageous manner, the invention allows this transformation to be carried out by providing a floor composed of several parts hinged together and of means for raising each part, as described in Patent N° FR-2.500.509.

Furthermore, in an installation of this kind, the seats may be positioned in the storage area at a rearward angle in relation to the vertical which is equal to the angle in relation to the horizontal of the corresponding floor.

Finally, in a more sophisticated variant, variable inclinations of all or of part of the rows of seats may be achieved, by means, for example, of the joints attaching the beams to the chairs.

I claim:

1. A system for driving movable undercarriages along a rail structure, providing for movement between a first area in which the undercarriages are drawn in close proximity, to a second area in which the undercarriages are extended apart, comprising:

at least two undercarriages each comprising a frame having rail engaging means, said frame having an upstream and a downstream portion in the direction of movement along said rail structure to said second area;

a foldable connection element (26), said connection element being connected to said rearward portion of a first undercarriage and a frontward portion of a second undercarriage;

one of said undercarriages and said connection element including means for connecting said connection element to said undercarriages in a manner that permits said connection element to move between said first and second undercarriages in the direction of the rail (7) and in a predetermined range of motion D;

engagement means (17) attached to said frame of said undercarriage which is retractable when the seats are stored and extendable when the seats are displayed;

motorized drive chain means (13) aligned with said rail structure and extending over the entire second area and over part of the first area;

stop blocks (15) mounted on said chain means at predetermined intervals having a length between L and L-D, L being the maximum length of the spacing between two consecutive undercarriages;

wherein said drive chain means is attached in at least one of said two undercarriages and extends parallel to the rail over the entire length of the second area (2) and over part of the first area (a), said stop blocks being engageable with said engagement means for imparting a force to extend said undercarriages along said rail.

2. The system according to claim 1, wherein said foldable connection element comprises at least one articulation element (26) having a longitudinal play (23) in which said range of motion D is created by said longitudinal play (23) of said at least one articulation element.

3. The system according to claim 1, wherein said engagement means (17) on the undercarriages comprises an elongated member pivotally joined to said frame and operative to engage said stop blocks and a spring operative to hold said elongated member in a projecting position and pointing toward the storage area, said engagement means being retractable upward as the stop-blocks travel toward the storage area.

4. The system according to claim 1 or claim 2, wherein said connection element (26) is fastened to each frame of said at least first and second undercarriages by jointed plates (21, 22), one of said plates being operatively attached to the downstream portion of a first undercarriage and the other of said plates being operatively attached to the upstream portion of a second undercarriage, one of said plates having a structure operative to initiate the folding of said connection element (26) at the beginning of the storage operation.

5. System according to claim 4, wherein at least one attachment of said connection element (26) onto the plates is dismountable.

6. Automatic seat installation apparatus for storage in a first area and arrangement in a second area of seats on an auditorium, comprising a floor containing at least two longitudinal rails, wherein said seat installation apparatus comprises in combination:

a plurality of rows of seats each row comprising a plurality of seats mounted on support beams (5);

at least two undercarriages (6, 6') each being in operative contact with a respective one of the rails and having attached in a supporting relationship, a portion of at least one support beam;

a system on each rail for driving said undercarriages forward comprising:

at least two undercarriages each comprising a frame having rail engaging means, said frame having an upstream and a downstream portion in the direction of movement along said rail structure to said second area;

a foldable connection element (26), said connection element being connected to a rearward portion of a first undercarriage and a frontward portion of a second undercarriage one of said undercarriages and said connection element including means for connecting said connection element to said undercarriages in a manner that permits said connection element to move between said first and second undercarriage in the direction of the rail (7) and in a predetermined range of motion D;

engagement means (17) attached to said frame of said undercarriage which is retractable when the seats are stored and extendable when the seats are displayed;

motorized drive chain means (13) aligned with said rail structure and extending over the entire second area and over part of the first area;

stop blocks (15) mounted on said chain means at predetermined intervals having a length between L and L-D, L being the maximum length of the spacing between two consecutive undercarriages;

wherein said drive chain means is attached to at least one of said two undercarriages and extends parallel to the rail over the entire length of the second area (2) and over part of the first area (1), said stop blocks being engageable with said engagement means for imparting a force to extend said undercarriages along said rail and said connection element being capable of covering said rails.

7. The seat installation apparatus according to claim 6, wherein said connection element comprises two sheet means (27, 28) of approximately equal size, said sheet means being attached together by at least one hinge (29).

8. The seat installation apparatus according to claim 7, wherein each said undercarriage frame comprises a stop means and wherein said range of motion D of said connection element (26) of said system is achieved on an upstream plate (21) attached to said connection element, said upstream plate further comprising, a sloping panel (24) positioned toward the storage area and designed to initiate the folding of the sheets when said stop means (25) on said frame constitutes an obstacle to it at the beginning of the storage operation.

9. The seat installation apparatus according to claim 8, wherein the maximum distance between said stop means (25) and the panel (24) of the upstream plate in a horizontal position is less than said range of motion D.

10. The seat installation apparatus according to claim 6, wherein said seat rails are below the surface of said floor and said floor contains at a level above the rails, lateral grooves (32) facing one another, said apparatus further comprising a continuous rail-covering element operative to slide within said groove and to cover said rail when the seats are in a stored position.

11. Installation according to claim 10, wherein at least the lower surfaces of said grooves are lined with a material (31) having a low coefficient of friction.

12. Installation according to claim 9, wherein said system for the driving of undercarriages draws said continuous covering element, which is fastened to an undercarriages.

13. Installation according to claim 11, wherein said continuous covering element is a flexible metal strip.

14. Installation according to claim 6, wherein the seats are foldable.

15. Installation according to claim 6, wherein the floor comprises several parts joined together and means for lifting each of the parts.

16. In the system for set forth in claim 1, a method comprising:

a first phase of deployment, wherein an upstream undercarriage driven by said drive chain means draws after it a downstream undercarriage from a storage area beyond the limit of said drive chain means into engagement with said drive chain means by means of said connection element being fully extended;

a second phase, wherein said downstream undercarriage is drawn forward individually by engagement of said engagement means on said frame with said stop-block on said drive chain means; and a first phase of reverse drive, wherein said upstream undercarriage is driven by said drive chain means back toward the downstream undercarriage whereby said connection element is folded;

thereby a downstream row of seats carried by said downstream undercarriage is driven back by an upstream row of seats carried by said upstream undercarriage when the upstream undercarriage comes into contact with the downstream undercarriage.

17. In the system set forth in claim 10, a method automatic installation for storage and positioning of seats in an auditorium, comprising:

a first phase of deployment, wherein an upstream row of seats driven by the drive chain means draws a downstream row of seats from the storage area beyond the reach of the said drive chain means into engagement with said drive chain means by means of said connection element being fully extended, and simultaneously causes the continuous rail covering element to slide away from the storage area;

a second phase, wherein the downstream row of seats is drawn individually by a conveyor stop-block on the drive chain means;

a first phase of return drive, wherein the upstream row of seats is driven by said drive chain means back toward the downstream row, whereby said connection element is folded, and the continuous rail covering element is simultaneously made to slide toward the storage area;

thereby the downstream row of seats is driven back by the upstream row of seats when the upstream undercarriages come into contact with the downstream undercarriages.

* * * * *